US009734934B2

(12) United States Patent
Huang et al.

(10) Patent No.: US 9,734,934 B2
(45) Date of Patent: Aug. 15, 2017

(54) COAXIAL CABLE AND MEDICAL CABLE USING SAME

(71) Applicant: Hitachi Metals, Ltd., Tokyo (JP)

(72) Inventors: Detian Huang, Hitachi (JP); Takanobu Watanabe, Hitachi (JP); Kimika Kudo, Kitaibaraki (JP); Haruyuki Watanabe, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/944,945

(22) Filed: Nov. 18, 2015

(65) Prior Publication Data

US 2016/0141071 A1 May 19, 2016

(30) Foreign Application Priority Data

Nov. 19, 2014 (JP) ..... 2014-234170

(51) Int. Cl.

| | |
|---|---|
| ***H01B 3/00*** | (2006.01) |
| ***H01B 3/44*** | (2006.01) |
| ***H01B 3/42*** | (2006.01) |
| ***H01B 1/02*** | (2006.01) |
| ***H01B 11/18*** | (2006.01) |

(52) U.S. Cl.

CPC ..... *H01B 3/441* (2013.01); *H01B 1/02* (2013.01); *H01B 3/423* (2013.01); *H01B 11/1839* (2013.01); *H01B 11/1847* (2013.01)

(58) Field of Classification Search

CPC ..... H01B 3/00

USPC ..... 174/110 R, 113 AS, 28

See application file for complete search history.

(56) References Cited

U.S. PATENT DOCUMENTS

| | | | | | |
|---|---|---|---|---|---|
| 1,939,264 | A * | 12/1933 | Hill | H01B 9/0611 | 174/25 R |
| 3,077,510 | A * | 2/1963 | Olds | H01B 9/0611 | 174/110 S |
| 3,496,281 | A * | 2/1970 | McMahon | H01B 7/0241 | 174/102 R |
| 4,440,821 | A * | 4/1984 | Komura | B29C 61/0616 | 156/158 |
| 4,767,673 | A * | 8/1988 | Nakano | B32B 7/14 | 156/233 |
| 5,569,876 | A * | 10/1996 | Podgorski | H01B 9/04 | 174/137 R |
| 5,831,215 | A * | 11/1998 | Ziemek | H01B 13/208 | 174/108 |
| 7,417,187 | B2 * | 8/2008 | Tanaka | A61B 8/00 | 174/113 R |

(Continued)

FOREIGN PATENT DOCUMENTS

| | | |
|---|---|---|
| JP | A-5-054729 | 3/1993 |
| JP | A-2002-367444 | 12/2002 |

(Continued)

*Primary Examiner* — Chau N Nguyen

(74) *Attorney, Agent, or Firm* — Roberts Mlotkowski Safran Cole & Calderon P.C.

(57) ABSTRACT

A coaxial cable includes a central conductor, and an electrical insulator formed around a circumference of the central conductor. The electrical insulator is made of an electrical insulating tape wrapped and overlapped around the circumference of the central conductor. The electrical insulating tape includes a plurality of voids formed on one outer circumferential surface.

8 Claims, 2 Drawing Sheets

(56) References Cited

U.S. PATENT DOCUMENTS

| | | | | |
|---|---|---|---|---|
| 7,655,867 | B2 * | 2/2010 | Schafer | H01F 27/322 174/120 R |
| 7,674,981 | B1 * | 3/2010 | Hesselbarth | H01B 11/1839 174/110 R |
| 8,691,393 | B2 * | 4/2014 | Cook | H05K 9/0084 174/102 R |
| 9,355,755 | B2 * | 5/2016 | Gundel | H01B 7/0838 |
| 2002/0088641 | A1 * | 7/2002 | Murga | H01B 11/1834 174/120 R |
| 2010/0122835 | A1 * | 5/2010 | Doi | B60R 16/0215 174/135 |
| 2014/0305676 | A1 * | 10/2014 | Sugiyama | H01B 11/002 174/108 |

FOREIGN PATENT DOCUMENTS

| | | |
|---|---|---|
| JP | A-2011-228064 | 11/2011 |
| JP | A-2012-104371 | 5/2012 |

* cited by examiner

COAXIAL CABLE AND MEDICAL CABLE USING SAME

The present application is based on Japanese patent application No. 2014-234170 filed on Nov. 19, 2014, the entire contents of which are incorporated herein by reference.

BACKGROUND OF THE INVENTION

1. Field of the Invention

This invention relates to a coaxial cable, which is suitable for medical applications such as ultrasound diagnosis, etc., and a medical cable using that coaxial cable.

2. Description of the Related Art

Conventionally, signal lines for medical cables for use in medical applications such as ultrasound diagnosis, etc. are designed to efficiently transmit a high frequency signal, and therefore use a coaxial structure capable of reducing internal signal leakage or external noise influence (See, JP-A-2002-367444.).

In the coaxial structure, an electrical insulator used to reduce electrostatic capacitance is a foamed electrical insulator containing large numbers of bubbles and having a lower overall relative permittivity than that of a non-foamed electrical insulator devoid of bubbles (See, JP-A-2011-228064).

See JP-A-2002-367444, JP-A-2011-228064, JP-A-2012-104371, and JP-A-5-54729.

SUMMARY OF THE INVENTION

Now, in forming the foamed electrical insulator, although bubbles are generated in an electrical insulating resin by a pressure full foaming method such as a physical foaming method, a chemical foaming method, or the like (JP-A-2012-104371), when a central conductor having a small outer diameter is used in order to reduce the diameter of the medical cables, there is a possibility of the central conductor being unable to withstand foaming pressure at the time of bubble generation, and being damaged or broken.

Also, in the pressure full foaming method such as a physical foaming method, a chemical foaming method, or the like, any attempt to form the thin foamed electrical insulator for the medical cables having a reduced diameter makes it difficult to form that foamed electrical insulator containing bubbles uniformly dispersed in the electrical insulating resin, and therefore no desired electrical properties can be achieved.

Incidentally, although a known method to form the foamed electrical insulator around a circumference of the central conductor is to wrap a foamed electrical insulating tape around the circumference of the central conductor to form the foamed electrical insulator therearound (JP-A-5-54729), the foamed electrical insulating tape, when wrapped around the circumference of the central conductor, tends to be broken by wrapping tension, due to large numbers of bubbles contained in the foamed electrical insulating tape.

In particular, when the foamed electrical insulating tape is wrapped around the circumference of the central conductor having an AWG (American Wire Gauge) of 48 or less, the very thin and very narrow foamed electrical insulating tape is required to be used, but, as explained above, because the foamed electrical insulating tape is broken by the wrapping tension, it is almost impossible to wrap the foamed electrical insulating tape around the circumference of the central conductor to form the foamed electrical insulator therearound.

Accordingly, it is an object of the present invention to provide a coaxial cable, which, even when using a central conductor having a small outer diameter, is capable of avoiding a damage or a break to the central conductor, and achieving desired electrical properties, and a medical cable using that coaxial cable.

(1) According to one embodiment of the invention, a coaxial cable comprises:

a central conductor; and an electrical insulator formed around a circumference of the central conductor, the electrical insulator comprising an electrical insulating tape wrapped and overlapped around the circumference of the central conductor, the electrical insulating tape including a plurality of voids formed on one outer circumferential surface.

In the one embodiment, the following modifications and changes may be made.

(i) The electrical insulating tape comprises a void containing layer, which is formed with the voids thereon, and a reinforcing layer, which is thermally fused and bonded to the void containing layer.

(ii) The void containing layer comprises polytetrafluoroethylene or polyethylene, and the reinforcing layer comprises polyethylene terephthalate.

(iii) The voids penetrate through the void containing layer.

(iv) The voids are round, and are staggered at each equal pitch.

(v) The coaxial cable further comprises a protector formed around a circumference of the electrical insulator.

(vi) The protector is made of a protective tape, which is wrapped around a circumference of the electrical insulator, or a protective layer, which is non-fully extruded and molded around a circumference of the electrical insulator.

(vii) The electrical insulating tape is not thicker than 30 μm in thickness.

(2) According to another embodiment of the invention, a medical cable comprises a bundle of core units each of which comprises a plurality of the coaxial cables as specified in (1) above stranded together.

(Points of the Invention)

The present invention allows for providing the coaxial cable, which, even when using the central conductor having a small outer diameter, is capable of avoiding damages or breaks to the central conductor, and achieving desired electrical properties, and the medical cable using that coaxial cable.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described a preferred embodiment according to the invention, in conjunction with the accompanying drawings.

Figure 1:
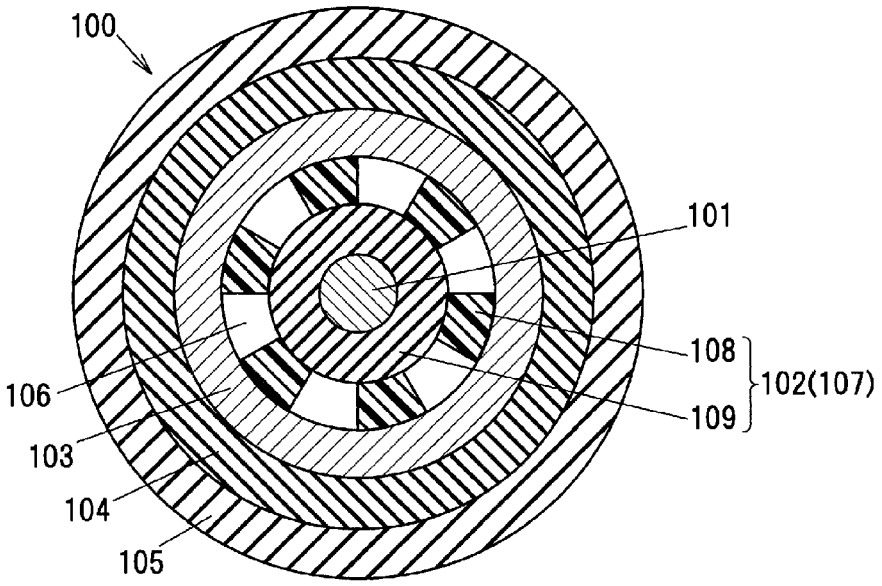
FIG. 1 is a schematic cross sectional view showing a coaxial cable according to the present invention.

As shown in FIG. 1, a coaxial cable 100 in the preferred embodiment of the present invention includes a central conductor 101, an electrical insulator 102, which is formed around a circumference of the central conductor 101, a protector 103, which is formed around a circumference of the electrical insulator 102, a shield 104, which is formed around a circumference of the protector 103, and a jacket 105, which is formed around a circumference of the shield 104.

The central conductor 101 is configured as an inner conductor of the coaxial structure, and is made of a solid wire or a stranded wire formed of a highly electrically conductive material, such as copper or a copper alloy or the like, and whose surface is plated with silver or tin or the like.

The electrical insulator 102 and the protector 103 are configured as an electrical insulator of the coaxial structure. The electrical insulator 102 is made of an electrical insulating tape 107 helically wrapped and overlapped around the circumference of the central conductor 101. The electrical insulating tape 107 includes a plurality of voids 106 uniformly dispersed and formed at an equal pitch on one outer circumferential surface.

This allows the porosity of the electrical insulator 102 to be uniform in the longitudinal direction of the coaxial cable 100, and as a result, the relative permittivity of the electrical insulator 102 is uniform in the longitudinal direction of the coaxial cable 100, thereby allowing the coaxial cable 100 to achieve desired electrical properties.

The protector 103 is designed to suppress the ingress of foreign substances into the voids 106 or the damage to the electrical insulating tape 107, so as not to lower the porosity of the electrical insulator 102, and is made of a protective tape, which is wrapped around the circumference of the electrical insulator 102, or a protective layer, which is non-fully (tubularly) extruded and molded around the circumference of the electrical insulator 102.

The shield 104 is configured as an outer conductor of the coaxial structure, and is made of a braided shield or a transversely wrapped shield formed of a highly electrically conductive material, such as copper or a copper alloy or the like.

The jacket 105 comprises a resin having high mechanical properties and a high chemical resistance such as fluororesin or the like, and is designed to suppress the degradation of electrical properties caused by a damage to the shield 104.

The voids 106 are open on the one surface of the electrical insulating tape 107, and their openings widen toward the one surface of the electrical insulating tape 107. This is because, when the electrical insulating tape 107 is wrapped around the circumference of the central conductor 101, its outer circumferential surface disposed around the outer side is longer in circumference than its inner circumferential surface disposed around the inner side, and the one outer circumferential surface of the electrical insulating tape 107 is therefore stretched.

Figure 2:
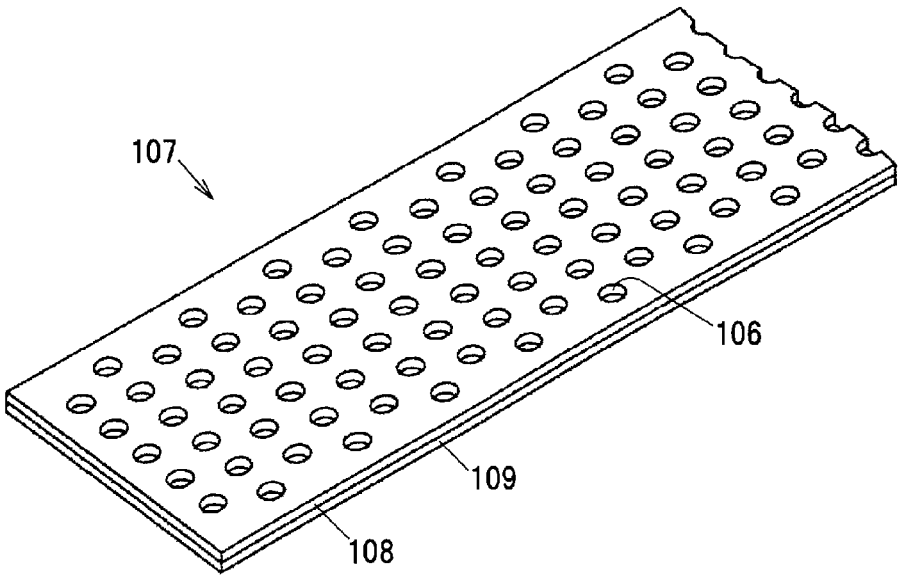
FIG. 2 is a schematic perspective view showing an electrical insulating tape.

As shown in FIG. 2, the voids 106 are round, and preferably are staggered at each equal pitch.

This allows for, when the electrical insulating tape 107 is wrapped around the circumference of the central conductor 101, preventing the local concentration of the wrapping tension, thereby effectively suppressing a resulting break to the electrical insulating tape 107 during the manufacture of the coaxial cable 100.

The electrical insulating tape 107 comprises a void containing layer 108 on the order of not thicker than 25 μm in thickness, which is formed with the voids 106 thereon, and a reinforcing layer 109 on the order of not thicker than 5 μm in thickness, which is thermally fused and bonded to the void containing layer 108. The electrical insulating tape 107 is on the order of not thicker than 30 μm in total thickness.

The void containing layer 108 comprises a material having a low relative permittivity, such as polytetrafluoroethylene or polyethylene or the like, and the reinforcing layer 109 comprises a material having high mechanical properties, such as polyethylene terephthalate or the like.

In particular, the reinforcing layer 109 comprises preferably ultra-drawn polyethylene terephthalate having a tensile strength of the order of 400 MPa.

This allows for, even when the reinforcing layer 109 is on the order of not thicker than 5 μm in thickness, sufficiently suppressing a stretching of the void containing layer 108 or a resulting break thereto caused by the wrapping tension when the electrical insulating tape 107 is wrapped around the circumference of the central conductor 101. It is therefore possible to contribute to reducing the diameter of the coaxial cable 100.

Now, the electrical insulating tape 107 is produced by embossing or punching a low relative permittivity sheet formed of a material having a low relative permittivity, such as polytetrafluoroethylene or polyethylene or the like, to form embossings or through holes therethrough, thermally and integrally fusing and bonding together the low relative permittivity sheet formed with the embossings or through holes therethrough and a reinforcing sheet formed of a material having high mechanical properties, such as polyethylene terephthalate or the like, to make an electrical insulating sheet, and subsequently cutting the electrical insulating sheet in a desired width and length.

This results in the embossings or through holes forming the bottomed depressed voids 106, with the voids 106 containing layer 108 being reinforced by the reinforcing layer 109, therefore making it possible to suppress a stretching of the void containing layer 108 and a resulting collapsing of the voids 106 due to the wrapping tension when the electrical insulating tape 107 is wrapped around the circumference of the central conductor 101, and suppress a break to the void containing layer 108 due to the voids 106 having weak mechanical strength.

Incidentally, the voids 106 formed by punching are larger in volume than the voids 106 formed by embossing. Therefore, in order to increase the porosity of the electrical insulator 102 to lower the relative permittivity of the electrical insulator 102, it is preferred to employ the voids 106 formation by punching, so that the voids 106 penetrate through the void containing layer 108.

Moreover, the voids 106 may be shaped into grooves. However, the round voids 106 are more preferred because of allowing the low relative permittivity sheet formed with the embossings or through holes therethrough to be integral, not separated, therefore allowing for easy lamination of the low relative permittivity sheet and the reinforcing sheet.

Therefore, the coaxial cable 100 in this embodiment, even when using the central conductor 101 having a small outer diameter to reduce the diameter of the coaxial cable 100, makes it possible to avoid a damage or a break to the central conductor 101, because no foamed electrical insulator is used as the electrical insulator 102.

Further, the coaxial cable 100 in this embodiment, even when using the thin electrical insulating tape 107 to form the thin electrical insulator 102 to reduce the diameter of the coaxial cable 100, makes it possible to achieve desired electrical properties because the voids 106 are uniformly present through the void containing layer 108.

Furthermore, the coaxial cable 100 in this embodiment, even when using the thin electrical insulating tape 107 to form the thin electrical insulator 102 to reduce the diameter of the coaxial cable 100, is not likely to cause a break to the electrical insulating tape 107 due to the wrapping tension when the electrical insulating tape 107 is wrapped around the circumference of the central conductor 101, because the void containing layer 108 is reinforced by the reinforcing layer 109.

For this reason, the coaxial cable 100 in this embodiment, even when the electrical insulating tape 107 is wrapped around the circumference of the central conductor 101 having an AWG (American Wire Gauge) of 48 or less, makes it possible to wrap the electrical insulating tape 107 around the circumference of the central conductor 101 with no break to the electrical insulating tape 107, to form the electrical insulator 102.

Figure 3:
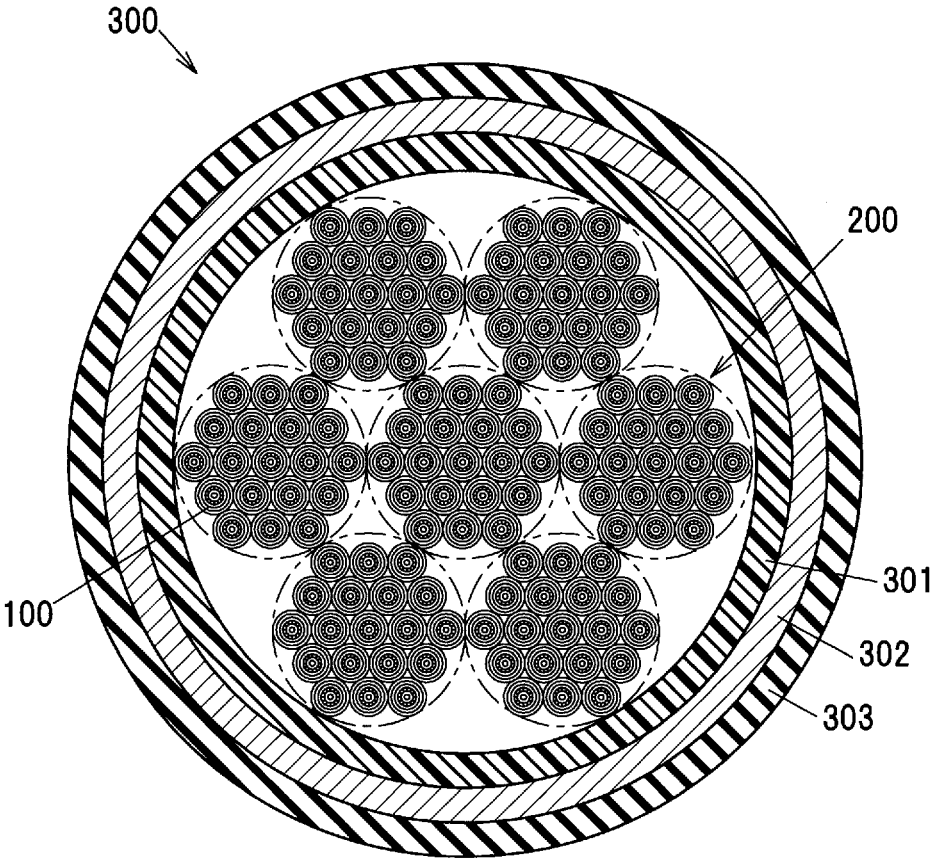
FIG. 3 is a schematic cross sectional view showing a medical cable according to the present invention.

Note that, as shown in FIG. 3, a plurality of core units 200 each of which comprises a plurality of the coaxial cables 100 stranded together are bundled with, for example, a binding tape 301, a braided shield 302, a sheath 303, etc., thereby being able to be used as a medical cable 300 such as a probe cable or the like. This can contribute to reducing the diameter of the medical cable 300 as well.

As described above, the present invention allows for providing the coaxial cable 100, which, even when using the central conductor 101 having a small outer diameter, is capable of avoiding a damage or a break to the central conductor 101, and achieving desired electrical properties, and the medical cable 300 using that coaxial cable 100.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A coaxial cable, comprising:

a central conductor having a diameter equal to or less than AWG48;

an electrical insulator formed around a circumference of the central conductor, the electrical insulator comprising an electrical insulating tape having a thickness equal to or less than 30 μm wrapped and overlapped around the circumference of the central conductor, the electrical insulating tape including a plurality of uniformly dispersed voids formed at an equal pitch on one outer circumferential surface, the electrical insulating tape comprising a void containing layer, which is formed with the voids thereon, and a reinforcing layer, which is thermally fused and bonded to the void containing layer; and a shield around the electrical insulator, wherein the void containing layer has a lower relative permittivity, a lower mechanical strength and a larger thickness than the reinforcing layer.

2. The coaxial cable according to claim 1, wherein the void containing layer comprises polytetrafluoroethylene or polyethylene, and the reinforcing layer comprises polyethylene terephthalate.

3. The coaxial cable according to claim 1, wherein the voids penetrate through the void containing layer.

4. The coaxial cable according to claim 1, wherein the voids are round, and are staggered at each equal pitch.

5. The coaxial cable according to claim 1, further comprising: a protector formed around a circumference of the electrical insulator.

6. The coaxial cable according to claim 5, wherein the protector is made of a protective tape, which is wrapped around a circumference of the electrical insulator, or a protective layer, which is non-fully extruded and molded around a circumference of the electrical insulator.

7. A medical cable, comprising: a bundle of core units each of which comprises a plurality of the coaxial cables according to claim 1 stranded together.

8. The coaxial cable according to claim 1, wherein the electrical insulating tape is helically wrapped and overlapped around the circumference of the central conductor such that the reinforcing layer contacts the central conductor.

* * * * *